United States Patent [19]

Gorman

[11] Patent Number: 5,074,563

[45] Date of Patent: Dec. 24, 1991

[54] IRON TYPE WEIGHTED GOLF CLUB HEAD

[75] Inventor: Geoffrey W. Gorman, Greer, S.C.

[73] Assignee: Dunlop Slazenger Corporation, Greenville, S.C.

[21] Appl. No.: 626,630

[22] Filed: Dec. 12, 1990

Related U.S. Application Data

[63] Continuation-in-part of Ser. No. 529,943, May 29, 1990.

[51] Int. Cl.[5] ..... A63B 53/04

[52] U.S. Cl. ..... 273/167 F; 273/167 H; 273/169

[58] Field of Search ..... 273/167 F, 169 H, 169, 273/171, 172

[56] References Cited

U.S. PATENT DOCUMENTS

| | | | |
|---|---|---|---|
| D. 229,434 | 11/1973 | Lrower | D34/5 GN |
| D. 267,965 | 2/1983 | Kobayashi | D21/220 |
| 2,087,685 | 7/1937 | Hackney | 273/77 |
| 2,846,228 | 8/1958 | Reach | 273/169 |
| 3,814,437 | 6/1974 | Winquist | 273/167 R |
| 4,128,244 | 12/1978 | Duclos | 273/164 |
| 4,136,877 | 1/1979 | Antonious | 273/164 |
| 4,325,553 | 4/1982 | Taylor | 273/167 |
| 4,326,326 | 4/1982 | MacDonald | 273/167 F X |
| 4,355,808 | 10/1982 | Jernigan et al. | 273/169 |
| 4,508,350 | 4/1985 | Duclos | 273/183 D |
| 4,511,145 | 4/1985 | Schmidt | 273/167 H |
| 4,569,523 | 2/1986 | Jarvis | 273/164 |
| 4,621,813 | 11/1986 | Solheim | 273/77 A |
| 4,826,172 | 5/1989 | Antonious | 273/169 |
| 4,907,806 | 3/1990 | Antonious | 273/167 F X |
| 4,921,252 | 5/1990 | Antonious | 273/164 |
| 4,938,470 | 7/1990 | Antonious | 273/169 X |

*Primary Examiner*—William H. Grieb

*Attorney, Agent, or Firm*—Lorusso & Loud

[57] ABSTRACT

An iron type golf club head comprising a heel portion, a toe portion, a bottom sole portion, a top ridge portion, a hosel portion, a face surface having a center of percussion, a rear surface, a peripheral mass formed on the rear surface adjacent the heel, toe and bottom sole portions, the peripheral mass being further formed on a portion of the top ridge portion, with substantially the remainder of the top ridge portion being devoid of the peripheral mass, and a weight portion extending from the rear surface and disposed behind the center of percussion.

12 Claims, 3 Drawing Sheets

IRON TYPE WEIGHTED GOLF CLUB HEAD

CROSS-REFERENCE TO RELATED APPLICATION

This application is a continuation-in-part of U.S. application Ser. No. 07/529,943, filed May 29, 1990, in the name of Geoffrey W. Gorman, entitled "AN IRON TYPE GOLF CLUB HEAD".

BACKGROUND OF THE INVENTION

1. Field of the Invention

This invention relates to instruments for impacting an object, and is directed more particularly to an iron type golf club head weighted for improved performance.

2. Description of the Prior Art

Attempts at improving the performance of golf clubs has produced a myriad of concepts, directed for the most part to improved distance through which a hit ball will travel and improved accuracy in both putting and driving.

One aspect of improvement has been in the area of weight distribution in iron type heads and one approach that has been used is peripheral, or perimeter, weighting, that is, locating weight around the periphery, or perimeter, of the club head. Peripheral weighting provides a cavity, or recess, centrally located in the rear of the club head. An example of peripheral weighting may be found in U.S. Pat. No. 4,621,813, issued Nov. 11, 1986 to Karsten Solheim.

Others, rather than dispersing weight around the periphery of a club head, have elected to concentrate weight midway of the club head, or at a point approximately behind the center of percussion. An example of such an arrangement may be seen in U.S. Pat. No. 2,087,685, issued July 20, 1937 to Clarence W. Hackney. The Hackney club head is essentially a flat blade with a bulbous weight member on the rear of the blade.

Still others have combined the perceived advantages of peripheral weighting with the perceived additional advantages of distributing weight within the cavity formed by peripheral weighting. Examples of such club heads may be seen in U.S. Pat. No. 3,814,437, issued June 14, 1974 in the name of S. William Winquist; U.S. Pat. No. 4,355,808, issued Oct. 26, 1982, in the name of Doyle D. Jernigan; U.S. Pat. No. 4,826,172, issued May 2, 1989 and U.S. Pat. No. 4,921,252, issued May 1, 1990, respectively in the name of Anthony J. Antonious. The Winquist patent shows a club head provided with perimeter weighting and, in addition, integral ribbing extending within the cavity at the rear of the club head, the ribbing being in the form of letters or symbols. Jernigan disposes a number of small weights along the bottom edge of the cavity and fills the cavity with epoxy. The object of Jernigan's invention is to tailor a club to an individual golfer's swing. The Antonious patents show the use of perimeter weighting and weight members within the cavity, the weight members within the cavity being spaced from the center of percussion. The Antonious arrangement is said to assist the player most particularly with respect to miss-hit balls, that is, balls struck off the center of percussion of the club head.

In Applicant's co-pending application, referred to above, there is shown and described a golf club head having a peripheral mass formed on the rear surface and extending therefrom to form a cavity. In addition, there is provided a weight portion disposed in the cavity behind the center of percussion. The peripheral mass extends around the entire periphery of the club head.

It is deemed beneficial to provide a generally similar club structure for more accurate players, in which a greater mass is concentrated behind the center of percussion. At the same time, it is also beneficial to leave undisturbed the total weight of the club. Accordingly, to add mass behind the center of percussion, it is desirable to reduce mass elsewhere, namely, from the peripheral mass.

SUMMARY OF THE INVENTION

An object of the present invention is to provide an instrument, such as a golf club head, with a combination of perimeter weighting and additional weighting, the additional weighting being disposed within the perimeter and immediately behind the center of percussion.

With the above and other objects in view, as will hereinafter appear, a feature of the present invention is the provision of an iron type golf club head comprising a heel portion, a toe portion, a bottom sole portion, a top ridge portion, a hosel portion, a face surface having a center of percussion, a rear surface, a peripheral mass formed on the rear surface adjacent the heel, toe and bottom sole portions, the peripheral mass being further formed on a portion of the top ridge portion, substantially the remainder of the top ridge portion being devoid of the peripheral mass, and a weight portion extending from the rear surface and disposed behind the center of percussion.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention from which its novel features and advantages will be apparent.

In the drawings.

DESCRIPTION OF THE PREFERRED EMBODIMENT

Figure 1:
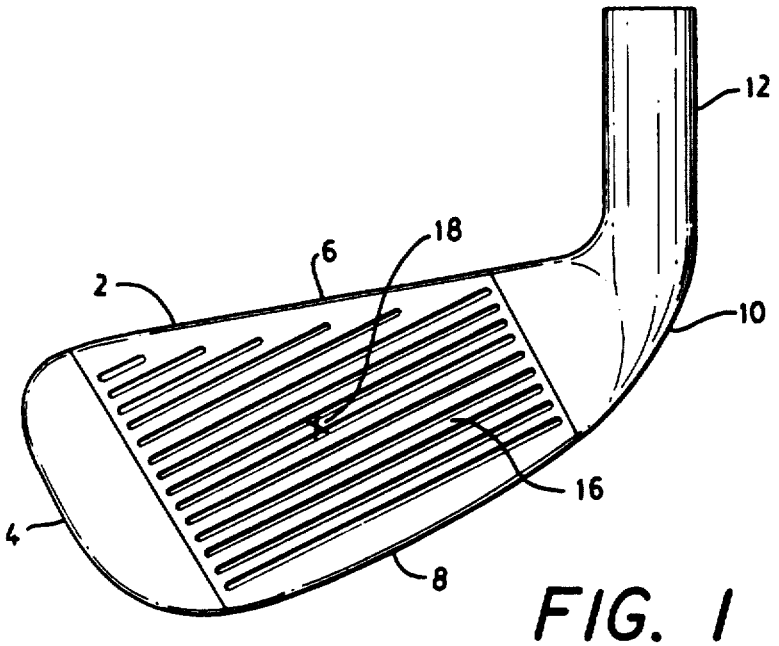
FIG. 1 is a front elevational view of one form of golf club head illustrative of an embodiment of the invention.

Referring to the drawings, it will be seen that the illustrative golf club head includes a blade member 2 having a toe portion 4, a top ridge portion 6, a bottom sole portion 8, and a heel portion 10. Extending from the heel portion region of the club head is a hosel portion 12 adapted to receive and be retained on a shaft member (not shown). The club head is provided with a substantially flat face surface 16 (FIG. 1) having therein a center of percussion 18, which is the spot ideally adapted to engage a golf ball at impact, and a rear surface 20 (FIG. 2).

A peripheral mass 22 (FIG. 2) is formed on the rear surface 20 adjacent the heel, bottom sole and toe portions of the blade member 2, and is further formed on a portion 14 of the top ridge portion, with substantially the remainder 23 of the top ridge portion being devoid of peripheral mass. Thus, the peripheral mass 22 is interrupted, having ends 19, 21 in the area of the top ridge portion 23 to define the interruption proximate the hosel portion 12. The peripheral mass 22 forms a cavity 24, with the rear surface 20 defining the bottom of the cavity.

A weight portion 26 (FIG. 2) extends from the rear surface 20 and is disposed on the rear surface 20 behind the center of percussion 18 (FIG. 1). Preferably, the weight portion 26 comprises a bridge extending from the peripheral mass 22 adjacent the bottom sole portion 8 of the club head to the end 19 of the peripheral mass. Accordingly, the weight portion 26, in cooperation with the peripheral mass adjacent the top ridge portion 6, the toe portion 4, and the bottom sole portion 8, defines a first cavity 24*a* bordered entirely by the mass 22 and the weight portion 26. The weight portion 26, in cooperation with the peripheral mass adjacent the bottom sole portion 8, and the heel portion 10, further defines a second cavity 24*b* bordered in part by the mass 22 and the weight portion 26, the second cavity being open in a direction toward the top ridge portion 14.

Figure 2:
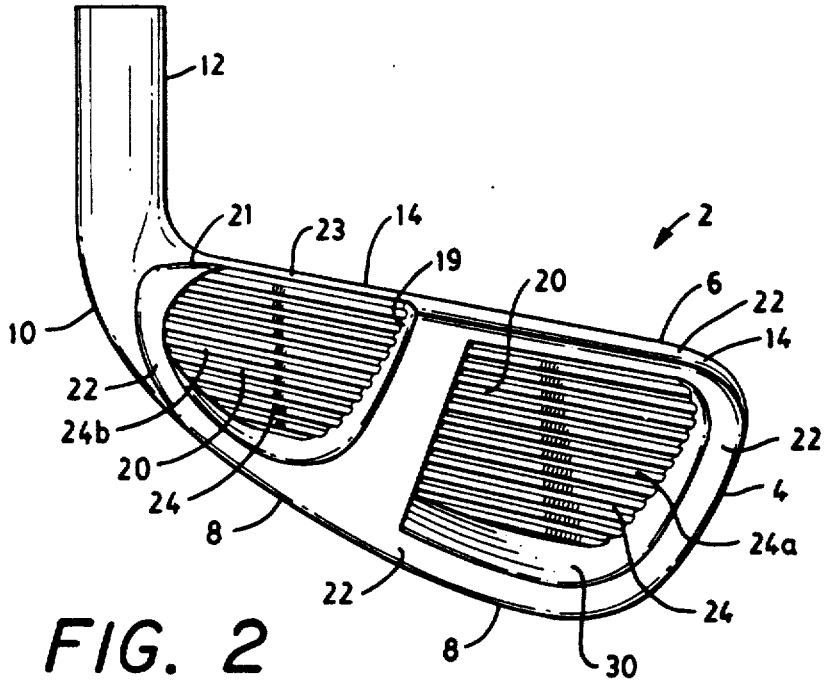
FIG. 2 is a rear elevational view thereof.
Figure 3:
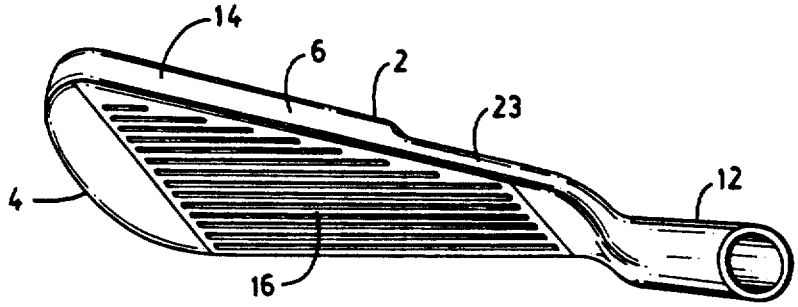
FIG. 3 is a top view thereof.
Figure 4:
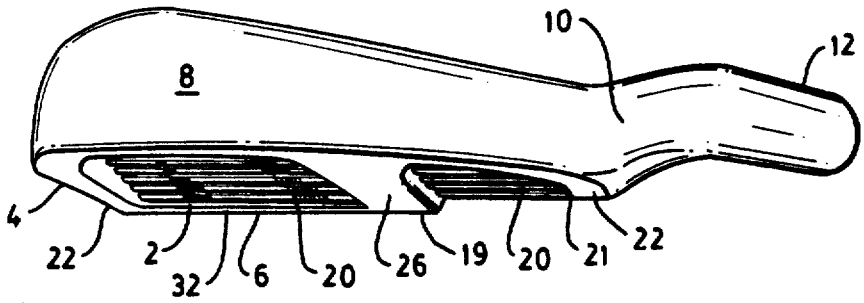
FIG. 4 is a bottom view thereof.
Figure 5:
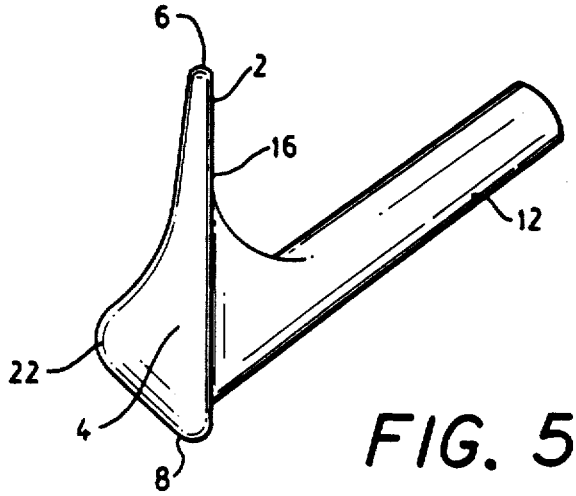
FIG. 5 is a toe end view thereof.
Figure 6:
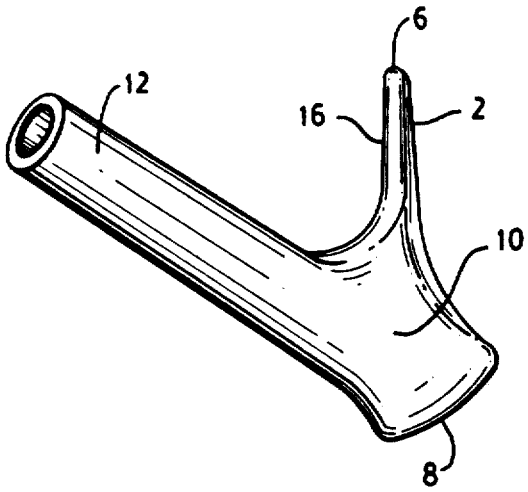
FIG. 6 is a heel end view thereof.

Referring to FIG. 2, it will be apparent that the thickness, and therefore the weight, of the peripheral mass 22 adjacent the bottom sole portion 8 substantially exceeds the thickness and weight of the peripheral mass adjacent the top ridge portion 6. Accordingly, a first wall 30 of the cavity 24 formed by the peripheral mass 22 adjacent the bottom sole portion 8 upstands from the rear surface 20 to an extent substantially greater than a second wall 32 (FIG. 4) of the cavity 24 formed by the peripheral mass adjacent the top ridge portion 6.

In like manner, the weight portion 26 has a thickness at its juncture with the peripheral mass adjacent the bottom sole portion 8 substantially exceeding its thickness at its juncture with the peripheral mass adjacent the top ridge portion 6. However, in all instances the extent of the weight portion 26 from the bottom 20 of the cavity 24 is no more than the maximum extent of the peripheral mass 22, that is, less than the extent of the peripheral mass adjacent the bottom sole portion 8.

The club head blade member 2 is formed of metal and the peripheral mass 22 is a solid metal mass of the same metal as the club head blade member 2. The weight portion 26 is a solid metal extension of the peripheral mass.

It is to be understood that the present invention is by no means limited to the particular construction herein disclosed and/or shown in the drawings, but also comprises any modifications or equivalents within the scope of the claims.

Having thus described my invention, what I claim as new and desire to secure by Letters Patent of the United States is:

1. An iron type golf club head comprising a heel portion, a toe portion. a bottom sole portion, a top ridge portion, a hosel portion, a face surface having a center of percussion, a rear surface, a peripheral mass formed on said rear surface adjacent said heel, toe and bottom sole portions, said peripheral mass being further formed on a portion of said top ridge portion, substantially the remainder of said top ridge portion being devoid of said peripheral mass, and a weight portion extending from said rear surface and disposed behind said center of percussion.

2. The golf club head in accordance with claim 1 in which said weight portion extends from said peripheral mass.

3. The golf club head in accordance with claim 2 in which said weight portion extends from said peripheral mass adjacent said bottom sole portion to said peripheral mass adjacent said top ridge portion, said weight portion being spaced from said peripheral mass adjacent said heel and toe portions.

4. The golf club head in accordance with claim 1 in which the thickness and weight of said peripheral mass adjacent said bottom sole portion substantially exceeds the thickness and weight of said peripheral mass adjacent said top ridge portion.

5. The golf club head in accordance with claim 4 in which a first wall of said cavity formed by said peripheral mass adjacent said bottom sole portion upstands from said rear surface to an extent substantially greater than a second wall of said cavity formed by said peripheral mass adjacent said top ridge portion.

6. The golf club head in accordance with claim 3 in which said weight portion comprises a solid metal portion.

7. The golf club head in accordance with claim 6 in which said head is formed of metal, said peripheral mass is a solid metal mass, and said weight portion comprises a solid metal bridge extending from said peripheral mass adjacent said bottom sole portion to an end of said peripheral mass adjacent said top ridge portion, said bridge occupying said disposition behind said center of percussion.

8. The golf club head in accordance with claim 7 in which said weight portion has a thickness at its juncture with said peripheral mass adjacent said bottom sole portion substantially exceeding its thickness at its juncture with said peripheral mass adjacent said top ridge portion.

9. The golf club head in accordance with claim 5 in which the extent of said weight portion from said bottom of said cavity is no more than the maximum extent of said peripheral mass.

10. An iron type golf club comprising a metal head portion, said head portion having a substantially flat face surface for engagement with a golf ball, said face surface having a center of percussion at which said face surface is adapted to engage said ball, said head portion having a rear surface, an interrupted peripheral mass of said metal formed on said rear surface and extending from said rear surface to form a cavity, a bottom of said cavity being defined by said rear surface, and a weight portion extending from said rear surface and being disposed behind said center of percussion, the extent of said weight portion from said bottom of said cavity not exceeding the maximum extent of said peripheral mass from said bottom of said cavity.

11. An iron type golf club head comprising a blade member having a toe portion, a top ridge portion, a bottom sole portion and a heel portion, said blade member having a substantially flat face surface having therein a center of percussion, said blade member having a rear surface, an interrupted peripheral mass extending from said rear surface adjacent said top ridge, toe, bottom sole, and heel portions, said peripheral mass having ends in the area of said top ridge portion to define said interruption of said peripheral mass, said interruption being proximate said heel portion, and a weight portion extending from said rear surface and interconnecting a first of said ends of said peripheral mass and said peripheral mass adjacent said bottom sole portion, said weight portion being disposed behind said center of percussion.

12. The golf club head in accordance with claim 11 in which said weight portion, in cooperation with said peripheral mass adjacent said top ridge portion, said toe portion and said bottom sole portion, defines a first cavity bordered entirely by said mass and said weight portion, and in which said weight portion, in cooperation with said peripheral mass adjacent said bottom sole portion and said heel portion, defines a second cavity bordered in part by said weight portion and said mass, said second cavity being open in a direction toward said top ridge portion.

* * * * *